US010056200B2

(12) United States Patent
Kashimura et al.

(10) Patent No.: US 10,056,200 B2
(45) Date of Patent: Aug. 21, 2018

(54) ELECTROMAGNETIC CONTACTOR

(71) Applicants: FUJI ELECTRIC CO., LTD., Kawasaki-shi (JP); FUJI ELECTRIC FA COMPONENTS & SYSTEMS CO., LTD., Chuo-ku, Tokyo (JP)

(72) Inventors: Osamu Kashimura, Hino (JP); Masaru Isozaki, Ichihara (JP); Hiroyuki Tachikawa, Yokohama (JP); Kouetsu Takaya, Kounosu (JP); Yasuhiro Naka, Kounosu (JP); Yuji Shiba, Kounosu (JP)

(73) Assignee: FUJI ELECTRIC FA COMPONENTS & SYSTEMS CO., LTD., Tokyo (JP)

( * ) Notice: Subject to any disclaimer, the term of this patent is extended or adjusted under 35 U.S.C. 154(b) by 21 days.

(21) Appl. No.: 14/344,789

(22) PCT Filed: Oct. 3, 2012

(86) PCT No.: PCT/JP2012/006359
§ 371 (c)(1),
(2) Date: Mar. 13, 2014

(87) PCT Pub. No.: WO2013/051264
PCT Pub. Date: Apr. 11, 2013

(65) Prior Publication Data

US 2015/0002250 A1 Jan. 1, 2015

(30) Foreign Application Priority Data

Oct. 7, 2011 (JP) ..... 2011-223144

(51) Int. Cl.
*H01H 9/00* (2006.01)
*H01H 1/58* (2006.01)
(Continued)

(52) U.S. Cl.
CPC ..... *H01H 1/58* (2013.01); *H01H 1/54* (2013.01); *H01H 50/10* (2013.01); *H01H 50/14* (2013.01); *H01H 50/546* (2013.01)

(58) Field of Classification Search
CPC .. H01H 1/06; H01H 1/58; H01H 1/54; H01H 1/20; H01H 50/54; H01H 50/641;
(Continued)

(56) References Cited

U.S. PATENT DOCUMENTS 3,465,270 A * 9/1969 Schattler ..... 335/132
3,651,437 A * 3/1972 Kiyoshi ..... 335/131
(Continued)

FOREIGN PATENT DOCUMENTS

CN 1225760 C 11/2005
CN 102208304 A 10/2011
(Continued)

OTHER PUBLICATIONS

PCT/ISA/210, "International Search Report for International Application No. PCT/JP2012/006359".
(Continued)

*Primary Examiner* — Shawki S Ismail
*Assistant Examiner* — Lisa Homza
(74) *Attorney, Agent, or Firm* — Manabu Kanesaka

(57) ABSTRACT

An electromagnetic contactor includes a contact mechanism including a pair of fixed contacts having fixed contact portions and interposed in a current conduction path, and a movable contact having a pair of movable contact portions capable of contacting to and separating from the pair of fixed contact portions. At least one of the pair of fixed contacts or the movable contact is formed in a shape to form magnetic fields generating Lorentz forces opposing electromagnetic repulsion forces generated in an opening direction between the fixed contact portions and the movable contact portions
(Continued)

when current is conducted. External connection conductors are connected to external connection terminals of the fixed contacts, an attachment direction of fixed portions fixed to the external connection terminal of the fixed contacts is set to cross a current flow direction flowing through the movable contact.

1 Claim, 8 Drawing Sheets

(51) Int. Cl.

| | |
|---|---|
| ***H01H 50/14*** | (2006.01) |
| ***H01H 1/54*** | (2006.01) |
| ***H01H 50/54*** | (2006.01) |
| ***H01H 50/10*** | (2006.01) |

(58) Field of Classification Search
CPC ..... H01H 50/00; H01H 50/546; H01H 71/10; H01H 3/222; H01H 77/101; H01H 31/24
USPC ..... 335/204
See application file for complete search history.

(56) References Cited

U.S. PATENT DOCUMENTS

| | | | | |
|---|---|---|---|---|
| 5,163,175 | A * | 11/1992 | Mori et al. | 335/132 |
| 5,495,220 | A * | 2/1996 | Takaya et al. | 335/274 |
| 5,986,528 | A * | 11/1999 | Meier et al. | 335/6 |
| 6,411,184 | B1 * | 6/2002 | Comtois et al. | 335/106 |
| 6,794,967 | B1 | 9/2004 | Park | |
| 8,519,811 | B2 | 8/2013 | Sugisawa et al. | |
| 2004/0066261 | A1 | 4/2004 | Nishida et al. | |
| 2009/0315653 | A1 * | 12/2009 | Suzuki et al. | 335/185 |
| 2010/0102905 | A1 | 4/2010 | Yamauchi et al. | |
| 2012/0326815 | A1 * | 12/2012 | Suzuki et al. | 335/185 |
| 2013/0113580 | A1 * | 5/2013 | Naka et al. | 335/196 |
| 2013/0115829 | A1 * | 5/2013 | Naka et al. | 439/883 |
| 2013/0127571 | A1 * | 5/2013 | Takaya et al. | 335/201 |
| 2013/0229247 | A1 * | 9/2013 | Tachikawa et al. | 335/196 |
| 2013/0229248 | A1 * | 9/2013 | Yokoyama et al. | 335/201 |
| 2013/0335175 | A1 * | 12/2013 | Tachikawa et al. | 335/147 |
| 2014/0062627 | A1 * | 3/2014 | Naka et al. | 335/189 |
| 2015/0002250 | A1 * | 1/2015 | Kashimura et al. | 335/204 |
| 2015/0033546 | A1 * | 2/2015 | Uchida | 29/602.1 |
| 2015/0034842 | A1 * | 2/2015 | Uchida | 250/492.3 |
| 2015/0048908 | A1 * | 2/2015 | Isozaki et al. | 335/6 |

FOREIGN PATENT DOCUMENTS

| | | | |
|---|---|---|---|
| JP | H04-123719 | A | 4/1992 |
| JP | H06-12957 | A | 1/1994 |
| JP | 2001-210170 | A | 8/2001 |
| JP | 2006-310251 | A | 11/2006 |

OTHER PUBLICATIONS

China Patent Office, "Office Action for CN 201280048732.7," dated Jul. 24, 2015.
Europe Patent Office, "Search Report for EP 12837693.6," dated Nov. 24, 2015.

* cited by examiner

ELECTROMAGNETIC CONTACTOR

RELATED APPLICATIONS

The present application is National Phase of International Application No. PCT/JP2012/006359 filed Oct. 3, 2012, and claims priority from Japanese Application No. 2011-223144 filed Oct. 7, 2011.

TECHNICAL FIELD

The present invention relates to an electromagnetic contactor including fixed contacts interposed in a current path and a movable contact and arranged to generate Lorentz forces opposing electromagnetic repulsion forces causing the movable contact to separate from the fixed contacts when current is conducted.

BACKGROUND ART

As an electromagnetic contactor which carries out the opening/closing of a current path, there has heretofore been proposed a switch of, for example, a configuration wherein a fixed contact is bent in a U-shape when viewed from a side, a fixed contact point is formed in a bent portion, and a movable contact point of a movable contact is disposed to be capable of contacting to and separating from the fixed contact point. The switch is arranged so that an opening speed is enhanced by increasing an electromagnetic repulsion force acting on the movable contact when a large current is interrupted, thus rapidly extending an arc (for example refer to PTL1).

Also, there has been proposed a contact structure of an electromagnetic contactor which causes an arc to be driven by a magnetic field generated by current flowing in the same configuration (for example refer to PTL 2).

CITATION LIST

Patent Literature

PTL 1: JP-A-2001-210170
PTL 2: JP-A-4-123719

SUMMARY OF INVENTION

Technical Problem

Meanwhile, the heretofore known example described in the PTL 1 is arranged such that the fixed contact is formed in the U-shape when viewed from a side, thus increasing an electromagnetic repulsion force to be generated. Because of this increased electromagnetic repulsion force, it is possible to enhance the opening speed of the movable contact when the large current is interrupted due to a short circuit or the like, rapidly extend the arc, and limit a fault current to a small value.

However, with an electromagnetic contactor configuring a circuit combined with a fuse or a circuit breaker, it is necessary to prevent a movable contact from opening due to electromagnetic repulsion forces when a large current is conducted. In order to apply the heretofore known example described in the PTL 2, generally, the spring force of a contact spring securing the contact pressure of the movable contact against the fixed contacts is increased.

When the contact pressure generated by the contact spring is increased in this way, it is also necessary to increase the thrust generated by an electromagnet which drives the movable contact, and the size of the overall configuration is increased. Alternatively, there is an unsolved problem that it is necessary to combine the electromagnetic contactor with a fuse or circuit breaker that has higher current limiting effect and is superior in interruption performance.

In order to solve the unsolved problems, it is conceivable that at least either the fixed contacts or movable contact is formed in a shape such as to increase Lorentz forces opposing electromagnetic repulsion forces generated in an opening direction between the fixed contacts and movable contact when current is conducted.

In this case, it is possible to increase the Lorentz forces opposing the electromagnetic repulsion forces generated in the opening direction between the fixed contacts and movable contact when the current is conducted, and thus suppress the opening direction electromagnetic repulsion forces. However, there is an unsolved problem that, depending on the shape of external connection conductors connected to external connection terminals of the fixed contacts of the electromagnetic contactor, the Lorentz forces that suppress the opening direction electromagnetic repulsion forces are weakened by being affected by magnetic fields generated around the external connection conductors by the currents flowing through the external connection conductors.

Therefore, the invention, having been contrived focusing on the heretofore described unsolved problems of the heretofore known example, has an object of providing an electromagnetic contactor capable of suppressing electromagnetic repulsion forces causing a movable contact to open when current is conducted, without being effected from the magnetic fields of the external connection conductors and without increasing the size of the overall configuration.

Solution to Problem

In order to achieve the object, a first aspect of an electromagnetic contactor according to the invention includes a contact mechanism including a pair of fixed contacts having fixed contact portions and interposed in a current conduction path and a movable contact having a pair of movable contact portions capable of contacting to and separating from the pair of fixed contact portions. At least one of the pair of fixed contacts or movable contact is formed in a shape such as to form magnetic fields generating Lorentz forces opposing electromagnetic repulsion forces generated in an opening direction between the fixed contact portions and the movable contact portions when current is conducted. Furthermore, external connection conductors are connected to external connection terminals of the fixed contacts, an attachment direction of fixed portions fixed to the external connection terminal of the fixed contacts being set to cross a current flow direction flowing through the movable contact.

According to this configuration, as at least either the fixed contacts or movable contact is formed in a shape, for example, an L-shape or a C-shape, such as to generate Lorentz forces opposing electromagnetic repulsion forces generated in the opening direction between the fixed contacts and movable contact when current is conducted, it is possible to prevent the movable contact from opening when a large current is conducted. Also, the attachment direction of the fixed portions of the external connection conductors connected to the external connection terminals of the fixed contacts is set so as to cross the current flow direction flowing through the movable contact. Because of this, magnetic fields generated in the fixed portions of the external connection conductors are prevented from affecting magnetic fields generating Lorentz forces.

Also, a second aspect of the electromagnetic contactor according to the invention is such that each of the external connection conductors includes a conductor portion connected on a side opposite to the external connection terminal of the fixed portion in a direction parallel to an extension direction of the movable contact, and the conductor portion has a direction of current flow reverse to that of the movable contact.

According to this configuration, the conductor portions connected to the fixed portions of the external connection conductors are disposed so as to be parallel to the extension direction of the movable contact and so that the direction of currents flowing through the conduction portions is in reverse of the direction of current flowing through the movable contact. Because of this, it is possible to increase the density of magnetic fluxes generating the Lorentz forces by making the orientation of magnetic fluxes generated by the conductor portions the same as the orientation of magnetic fluxes forming the magnetic fields generating the Lorentz forces.

Also, a third aspect of the electromagnetic contactor according to the invention is such that each of the external connection conductors has a busbar including a protection unit.

According to this configuration, due to the busbar configuring the protection unit, it is possible to increase the density of magnetic fluxes in the magnetic fields generating the Lorentz forces opposing electromagnetic repulsion forces generated in an opening direction between the fixed contacts and movable contact when current is conducted.

Also, a fourth aspect of the electromagnetic contactor according to the invention includes a contact mechanism including a pair of fixed contacts interposed in a current conduction path and having fixed contact portions, and a movable contact having a pair of movable contact portions capable of contacting to and separating from the pair of fixed contact portions. The contact mechanism is such that at least one of the pair of fixed contacts or movable contact is formed in a shape such as to form magnetic fields generating Lorentz forces opposing electromagnetic repulsion forces generated in an opening direction between the fixed contact portions and movable contact portions when current is conducted. Further, a magnetic body suppressing an effect of magnetic fields generated in external connection conductors connected to the fixed contacts is disposed so as to cover the contact mechanism.

According to this configuration, it is possible to suppress the weakening of the Lorentz forces by the magnetic body shielding the magnetic fields generated by the currents flowing through the external connection conductors connected to the external terminals of the fixed contacts from affecting the magnetic fields generating the Lorentz forces.

Also, a fifth aspect of the electromagnetic contactor according to the invention is such that the movable contact includes a conductive plate supported by a movable portion and having contact portions on two end sides of a front or rear surface. Also, each of the fixed contacts includes an L-shaped conductive plate portion having a first conductive plate portion supporting the fixed contact portion facing the contact portion of the conductive plate and directed toward an outer side of the end of the conductive plate in parallel to the conductive plate, and a second conductive plate portion extending from an outward end portion of the first conductive plate portion through the outer side of the end portion of the conductive plate.

According to this configuration, the density of magnetic fluxes generating the Lorentz forces opposing the electromagnetic repulsion forces which cause the movable contact and fixed contacts to open when current is conducted through the electromagnetic contactor is increased in the second conductive plate portions configuring the L-shaped conductive plate portions.

Also, a sixth aspect of the electromagnetic contactor according to the invention is such that each of the fixed contacts, having a third conductive plate portion extending inward from the end portion of the second conductive plate portion in parallel to the conductive plate and is configured in a C-shape.

According to this configuration, as the direction of currents flowing through the third conductive plate portions is the reverse of the direction of current flowing through the movable contact, it is possible to further increase the density of magnetic fluxes generating the Lorentz forces.

Also, a seventh aspect of the electromagnetic contactor according to the invention is such that the movable contact includes a conductive plate portion supported by a movable portion, C-shaped bent portions formed on two ends of the conductive plate portion, and contact portions formed on each surface of the C-shaped bent portions facing the conductive plate portion. Also, the fixed contacts include L-shaped conductive plate portions having a pair of first conductive plate portions, each having a contact portion formed inside the C-shaped bent portion and disposed in parallel to the conductive plate portion to contact the corresponding contact portion of the movable contact, and second conductive plate portions extending from an inner side end of each of the pair of first conductive plate portions through the inner side of an end portion of the C-shaped bent portion.

According to this configuration, it is possible, on the movable contact side, to generate the Lorentz forces opposing the electromagnetic repulsion forces which cause the movable contact and fixed contacts to open when current is conducted through the electromagnetic contactor.

Advantageous Effects of Invention

According to the invention, it is possible to generate the Lorentz forces opposing the electromagnetic repulsion forces generated in die opening direction between the fixed contacts and movable contact when a large current is conducted through the contact mechanism having the fixed contacts interposed in the current conduction path and the movable contact. Because of this, it is possible to reliably prevent the movable contact from opening when the large current is conducted without using a mechanical pressing force. Also, it is possible to prevent the Lorentz forces from weakening by preventing the magnetic fields generated by the currents flowing through the external connection conductors from affecting the magnetic fields generating the Lorentz forces opposing the opening direction electromagnetic repulsion forces when current is conducted. Furthermore, when the external connection conductors are formed with the conductive portions having a current flow in a direction reverse to that of the movable contact, it is possible to increase the density of magnetic fluxes generating the Lorentz forces.

DESCRIPTION OF EMBODIMENTS

Figure 1:
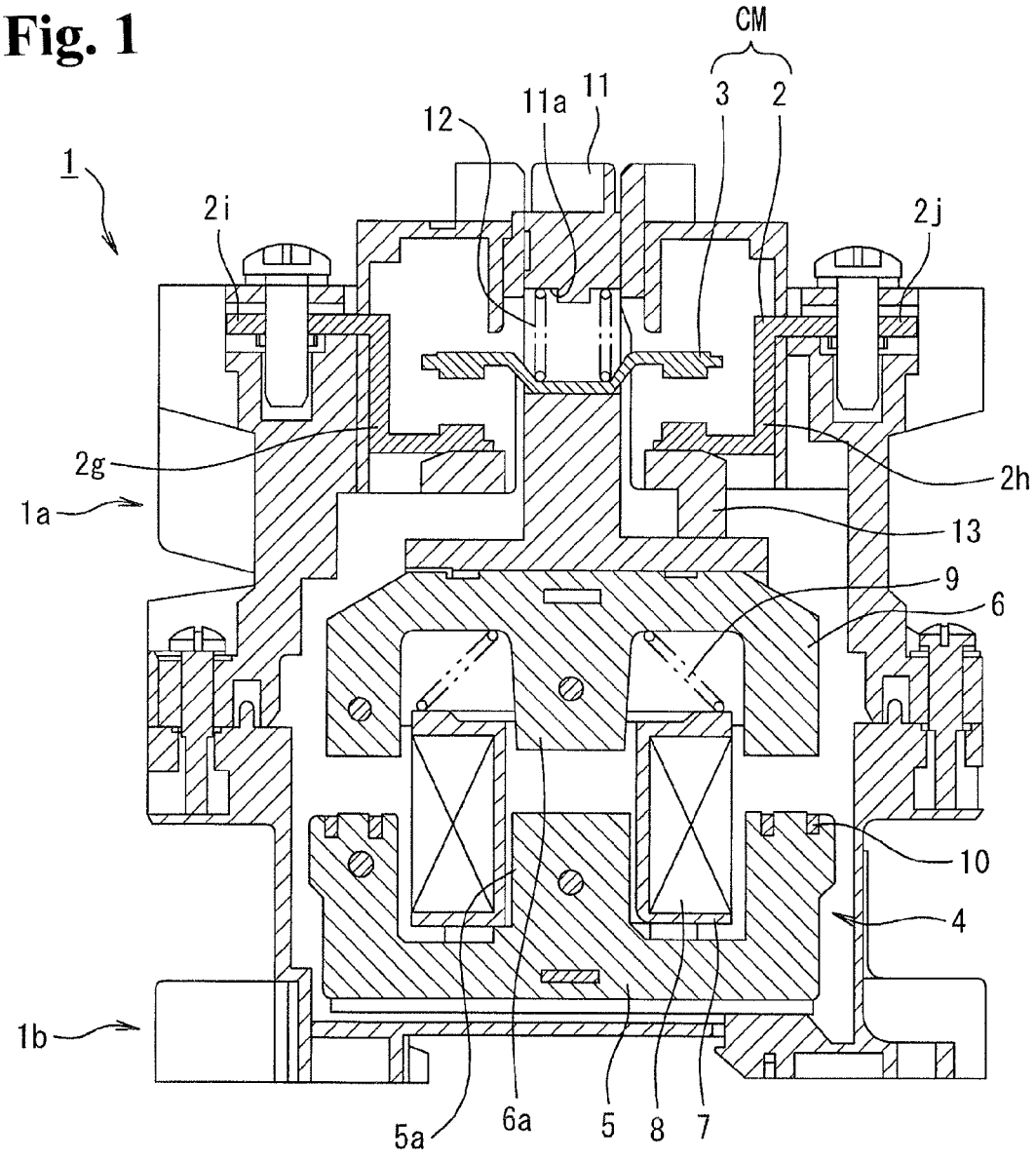
FIG. 1 is a sectional view showing a first embodiment of an electromagnetic contactor according to the invention.

Hereafter, a description will be given, based on the drawings, of embodiments of the invention. FIG. 1 is a sectional view showing an electromagnetic contactor to which a contact mechanism according to the invention is applied.

In FIG. 1, reference 1 is a main body case made of, for example, synthetic resin. The main body case 1 has a dual-partitioning structure formed of an upper case 1*a* and a lower case 1*b*. A contact mechanism CM is installed in the upper case 1*a*. The contact mechanism CM includes fixed contacts 2 disposed fixed to the upper case 1*a* and a movable contact 3 disposed so as to be capable of contacting to and separating from the fixed contacts 2.

Also, an operating electromagnet 4 which drives the movable contact 3 is disposed in the lower case 1*b*. The operating electromagnet 4 is such that a fixed iron core 5 formed of an E-shaped leg type laminated steel plate and a movable iron core 6 similarly formed of an E-shaped leg type laminated steel plate are disposed opposite to each other.

An electromagnetic coil 8, wound in a coil holder 7, which is supplied with a single-phase alternating current is fixed to a central leg portion 5*a* of the fixed iron core 5. Also, a return spring 9 which urges the movable iron core 6 in a direction away from the fixed iron core 5 is disposed between the upper surface of the coil holder 7 and the root of a central leg 6*a* of the movable iron core 6.

Furthermore, a shading coil 10 is embedded in the upper end face of the outer side leg portion of the fixed iron core 5. It is possible, due to the shading coil 10, to suppress variations in electromagnetic attractive force, noise, and vibration caused by a change in alternating flux in a single-phase alternating current electromagnet.

Further, a contact holder 11 is connected to the upper end of the movable iron core 6. The movable contact 3 is held, in an insertion hole 11*a* formed on the upper end side of the contact holder 11 in a direction perpendicular to the axis, by being pressed downward against the fixed contacts 2 by a contact spring 12 so as to obtain a predetermined contact pressure.

As shown in enlarged dimension in FIGS. 3(*a*)-3(*d*), the movable contact 3 is such that the central portion thereof is configured of an elongated rod-shaped conductive plate portion 3*a* pressed by the contact spring 12, and movable contact portions 3*b* and 3*c* are formed one on each end side lower surface of the conductive plate portion 3*a*.

Meanwhile, as shown in enlarged dimension in FIGS. 3(*a*)-3(*d*), each of the fixed contacts 2 includes an L-shaped conductive plate portion 2*g*, 2*h* which is formed of a first conductive plate portion 2*c*, 2*d*, supporting the corresponding one of the pair of fixed contact portions 2*a* and 2*b* facing the movable contact portions 3*b* and 3*c* of the movable contact 3 from below, which is directed outward parallel to the conductive plate portion 3*a*, and a second conductive plate portion 2*e*, 2*f* extending upward, through the outer side of each respective end portion of the conductive plate portion 3*a*, from an outer side end portion of the first conductive plate portion 2*c*, 2*d* which is on the outer side of the conductive plate portion 3. Further, external connection terminals 2*i* and 2*j* extended toward the outer side of the upper case 1*a* and fixed are connected respectively to the respective upper ends of the L-shaped conductive plate portions 2*g* and 2*h*, as shown in FIG. 1.

Figure 2A:
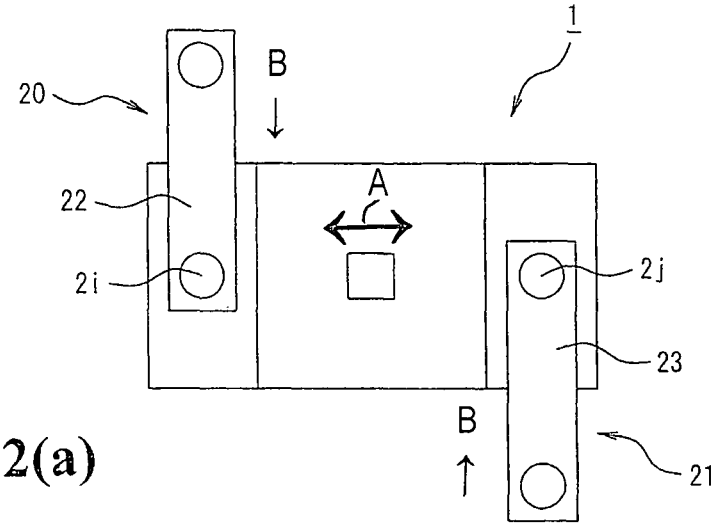
FIGS. 2(*a*)-2(*c*) are plan views of FIG. 1, wherein FIG. 2(*a*) is a plan view showing a state in which external connection conductors extend in opposite directions, FIG. 2(*b*) is a plan view showing a state in which the external connection conductors extend in the same direction, and FIG. 2(*c*) is a plan view showing a heretofore known example.
Figure 2B:
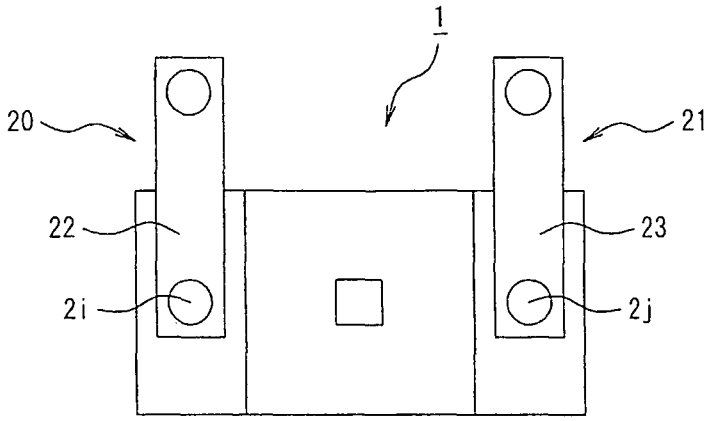
Figure 2C:
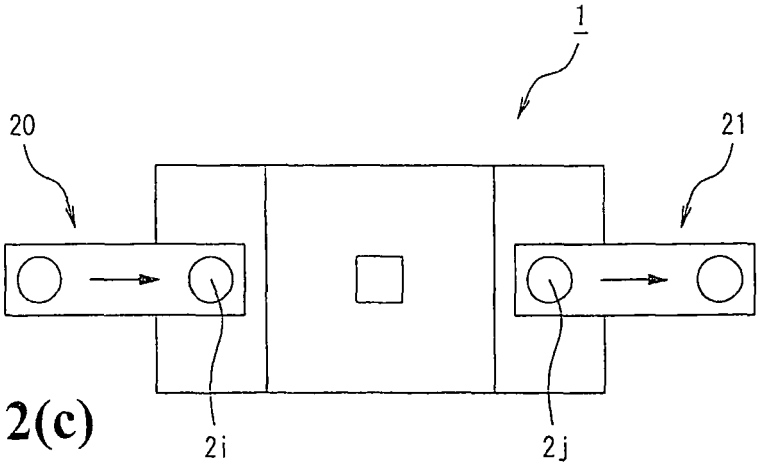
Fig. 2(c) Prior Art
Figure 3A:
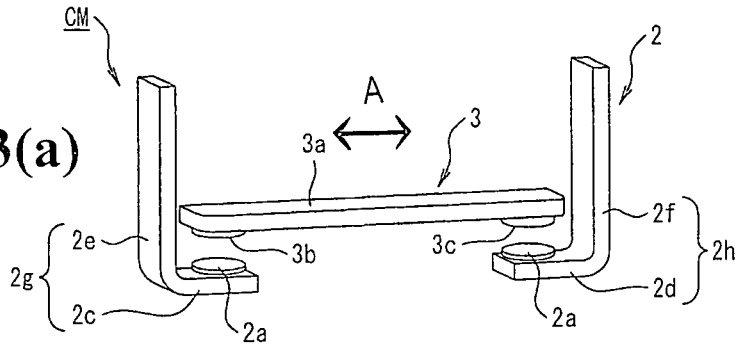
FIGS. 3(*a*)-3(*d*) are diagrams showing a contact mechanism which can be applied to the invention, wherein FIG. 3(*a*) is a perspective view, FIG. 3(*b*) is a sectional view showing the contact mechanism when opened, FIG. 3(*c*) is a sectional view showing the contact mechanism when closed, and FIG. 3(*d*) is a sectional view showing magnetic fluxes when closed.
Figure 3B:
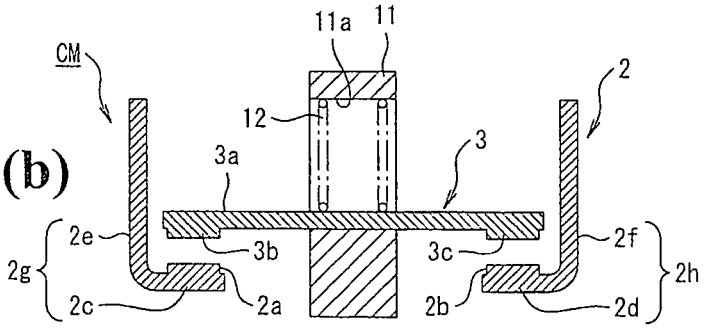
Figure 3C:
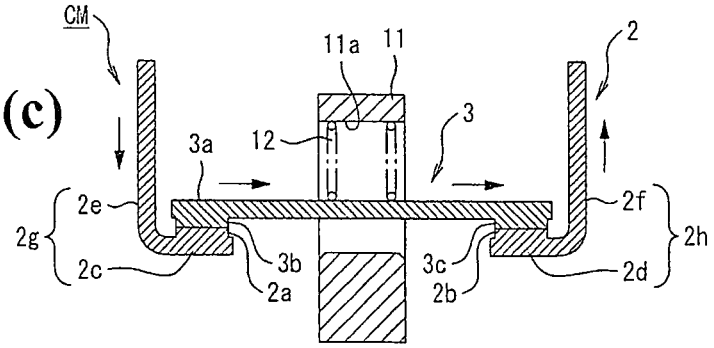
Figure 3D:
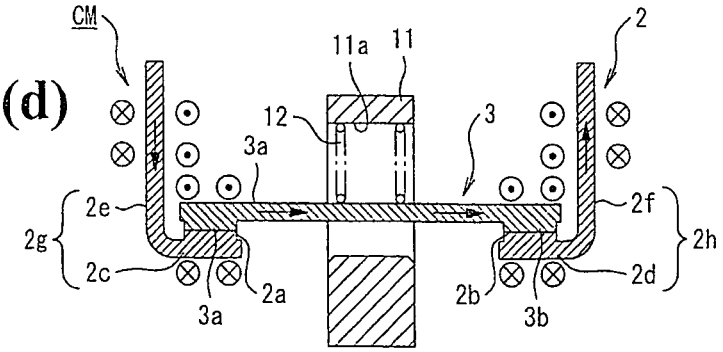

Further, external connection conductors 20 and 21 are connected to the external connection terminals 2*i* and 2*j*, as shown in FIGS. 2(*a*)-2(*c*). The external connection conductors 20 and 21 are connected so that fixed portions 22 and 23 connected to the external connection terminals 2*i* and 2*j* extend in a direction perpendicular to a direction in which current flows through the conductive plate portion 3*a* of the movable contact 3 (extension direction A of the movable contact 3). Namely, an attachment direction B of each of the fixed portions 22, 23 fixed to the external connection terminals 2*i*, 2*j* of the fixed contacts is set to cross a current flow direction flowing through the movable contact 3. Herein, the external connection conductors 20 and 21 may extend either in opposite directions, as shown in FIG. 2(*a*), or in the same direction, as shown in FIG. 2(*b*).

Next, a description will be given of an operation of the heretofore described first embodiment.

For now, in a state in which the electromagnetic coil 8 of the operating electromagnet 4 is in a non-energized state, no electromagnetic attractive force is generated between the fixed iron core 5 and movable iron core 6, the movable iron core 6 is urged by the return spring 9 in a direction in which the movable iron core 6 separates upward from the fixed iron core 5, and the upper end of the movable iron core 6 is held in a current interruption position by abutting against a stopper 13.

In a state in which the movable iron core 6 is in the current interruption position, the movable contact 3 contacts the bottom portion of the insertion hole 11*a* of the contact holder 11 by the contact spring 12, as shown in FIG. 3(*a*). In this state, the movable contact portions 3*b* and 3*c* formed one on each end side of the conductive plate portion 3*a* of the movable contact 3 are separated upward from the fixed contact portions 2*a* and 2*b* of the fixed contact 2, and the contact mechanism CM is in an open state.

When a single-phase alternating current is supplied to the electromagnetic coil 8 of the operating electromagnet 4 in the open state of the contact mechanism CM, an attractive force is generated between the fixed iron core 5 and movable iron core 6, and the movable iron core 6 is attracted downward against the urging force of the return spring 9. By so doing, the movable contact 3 supported by the contact holder 11 descends, and the movable contact portions 3*b* and 3*c* contact the fixed contact portions 2*a* and 2*b* of the fixed contact 2 due to the contact pressure of the contact spring 12, thus attaining a closed state.

When the closed state is attained, a large current in the order of, for example, several ten kiloamperes input from, for example, the external connection terminal 2*i* of the fixed contact 2 connected to a direct current power supply (not shown) is supplied to the movable contact portion 3*b* of the movable contact 3 through the second conductive plate portion 2*e*, first conductive plate portion 2*c*, and fixed contact portion 2*a*. The large current supplied to the movable contact portion 3*b* is supplied to the fixed contact portion 2*b* through the conductive plate portion 3*a* and movable contact portion 3*c*. The large current supplied to the fixed contact portion 2*b* is supplied to the first conductive plate portion 2*d*, second conductive plate portion 2*f*, and external connection terminal 2*j*, and a current conduction path through which the current is supplied to an external load is formed.

At this time, electromagnetic repulsion forces are generated in a direction such as to cause the movable contact portions 3*b* and 3*c* to open between the fixed contact portions 2*a* and 2*b* of the fixed contacts 2 and the movable contact portions 3*b* and 3*c* of the movable contact 3.

However, the fixed contacts 2 are such that as the L-shaped conductive plate portions 2*g* and 2*h* are formed by the first conductive plate portions 2*c* and 2*d* and second conductive plate portions 2*e* and 2*f*, as shown in FIG. 3(*a*), by the heretofore described current path shown in FIG. 3(*c*) being formed, the magnetic fields shown in FIG. 3(*d*) are formed in response to the current flowing through the movable contact 3 (a circle with an inscribed x represents the movement of charges going rearward into the sheet and a circle with an inscribed dot represents the movement of charges coming frontward out of the sheet). Because of this, Lorentz forces which cause the movable contact portions 3*b* and 3*c* to be pressed toward the fixed contact portion 2*a* and 2*b* sides against the opening direction electromagnetic repulsion forces can be caused to act on the conductive plate portion 3*a* of the movable contact 3 in accordance with Fleming's left-hand rule.

Consequently, even when electromagnetic repulsion forces are generated in a direction such as to cause the movable contact 3 to open, it is possible to generate Lorentz forces opposing the electromagnetic repulsion forces, meaning that it is possible to reliably prevent the movable contact 3 from opening. Because of this, it is possible to reduce the pressing force of the contact spring 12 supporting the movable contact 3, as a result of which t is also possible to reduce the thrust generated by the operating electromagnet 4, and it is thus possible to reduce the size of the overall configuration.

Moreover, in this case, it being only necessary to form the L-shaped conductive plate portions 2*g* and 2*h* in the fixed contacts 2, it is possible to easily carry out the processing of the fixed contacts 2, and there is no need for a separate member which generates an electromagnetic force or mechanical force opposing the opening direction electromagnetic repulsion forces, meaning that it does not happen that the number of parts increases, and it is thus possible to suppress an increase in the size of the overall configuration.

Furthermore, the fixed portions 22 and 23 of the external connection conductors 20 and 21 connected to the external connection terminals 2*i* and 2*j* of the fixed contacts 2 extend in a direction perpendicular to the direction in which current flows through the conductive plate portion 3*a* of the movable contact 3. Because of this, the magnetic field generated by the current flowing through the fixed portion 22 of the external connection conductor 20 does not act in a direction such as to weaken the magnetic field generated by the current flowing through the conductive plate portion 3*a* of the movable contact 3, and it is thus possible to generate large Lorentz forces.

Incidentally, a consideration will be given of a case in which the fixed portions 22 and 23 of the external connection conductors 20 and 21 are extended parallel to the direction in which the current flows through the conductive plate portion 3*a* of the movable contact 3 and connected to the external connection terminals 2*i* and 2*j* of the fixed contacts 2, as shown in FIG. 2(*c*). In this case, the magnetic fields generated by the currents flowing through the fixed portions 22 and 23 of the external connection conductors 20 and 21 interfere with the magnetic field generated by the current flowing through the conductive plate portion 3*a* of the movable contact 3. Because of this, the Lorentz forces opposing the electromagnetic repulsion forces generated in a direction such as to cause the movable contact 3 to open when current is conducted decreases by the magnetic field generated in the conductive plate portion 3*a* of the movable contact 3 being weakened.

Subsequently, when a current interruption condition is attained by interrupting the current supplied to the operating electromagnet 4 in the closed state of the contact mechanism CM, the movable contact portions 3*b* and 3*c* of the movable contact 3 move upward away from the fixed contact portions 2*a* and 2*b* of the L-shaped conductive plate portions 2*g* and 2*h* of the fixed contact 2, as shown in FIG. 3(*b*). At this time, arcs are generated between the fixed contact portions 2*a* and 2*b* and movable contact portions 3*b* and 3*c*.

The arcs generated in this way are extinguished by an arc extinguishing mechanism such as an arc extinguishing magnet disposed along the movable contact 3, although not shown, and the currents between the contact portions 2*a* and 2*b* of the fixed contacts 2 and the movable contact portions 3*b* and 3*c* of the movable contact 3 are interrupted, thus returning to the open state.

Next, a description will be given, referring to FIGS. 4(*a*)-4(*c*), of a second embodiment of the invention.

In the second embodiment, the external connection conductors connected to the external connection terminals 2*i* and 2*j* of the fixed contacts 2 are configured so as to strengthen the magnetic field generated in the conductive plate portion 3*a* of the movable contact 3.

Figure 4A:
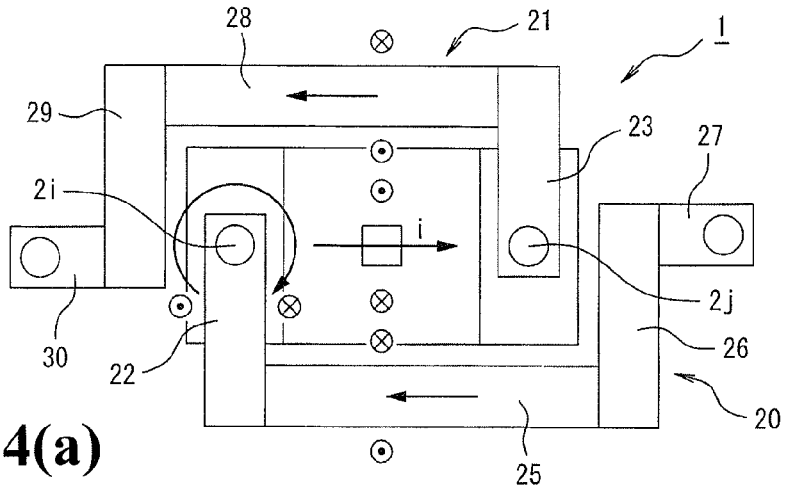
FIGS. 4(*a*)-4(*c*) are plan views of a second embodiment of the invention, wherein FIG. 4(*a*) is a plan view showing U-shaped external connection conductors, FIG. 4(*h*) is a plan view showing L-shaped external connection conductors, and FIG. 4(*c*) is a plan view showing cranked external connection conductors.
Figure 4B:
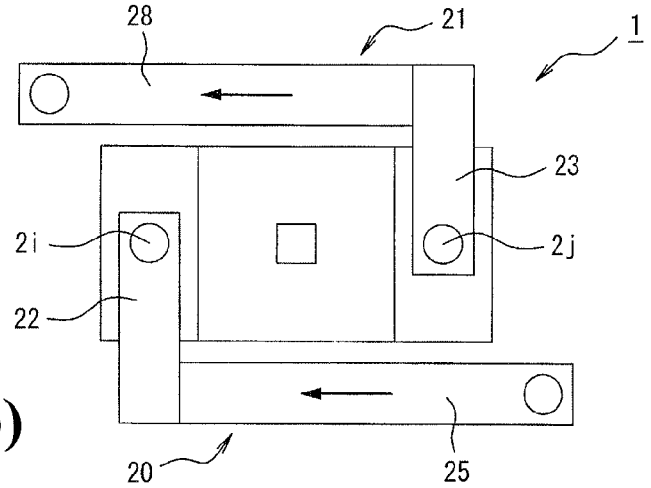
Figure 4C:
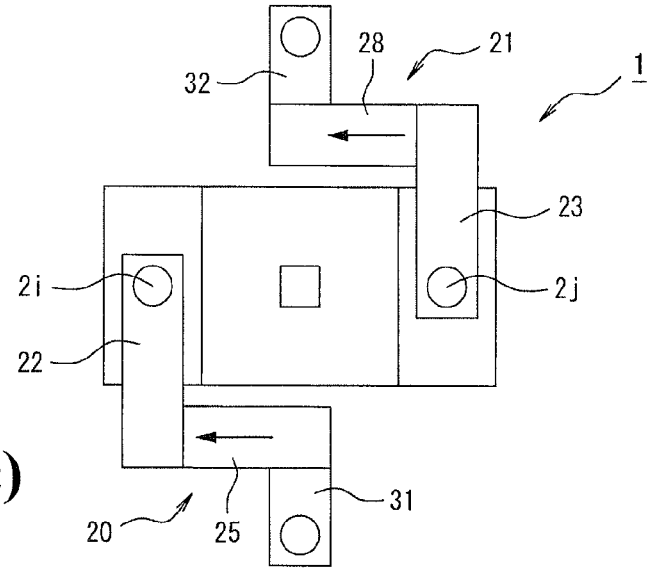

That is, in the second embodiment, the configuration of the external connection conductors 20 and 21 in FIG. 2(*a*) in the first embodiment is changed, as shown in FIG. 4(*a*).

Firstly, the external connection conductor 20 includes a first conductor portion 25 extending, along the front surface of the upper case 1*a* and parallel to the conductive plate portion 3*a* of the movable contact 3, to the other end of the fixed portion 22 connected to the external connection terminal 2*i* of the fixed contact 2, a second conductor portion 26 extending rearward from the other end of the conductor portion 25, along the side surface of the upper case 1*a*, to a position opposite to the external connection terminal 2*j*, and an external connection conductor portion (third conductor portion) 27 extending from the other end of the second conductor portion 26 in a direction same as the extension direction of the conductive plate portion 3*a* of the movable contact 3.

Also, the external connection conductor 21 also includes a first conductor portion 28, a second conductor portion 29, and an external connection conductor portion 30, so that the external connection conductors 20 and 21 are symmetrical with respect to a point.

According to the second embodiment, the fixed portions 22 and 23 of the external connection conductors 20 and 21 are disposed so as not to affect the magnetic field generated by the current flowing through the conductive plate portion 3*a* of the movable contact 3, in the same way as in the first embodiment. Further, the external connection conductors 20 and 21 have the first conductor portions 25 and 28 extending parallel to the conductive plate portion 3*a* of the movable contact 3, and the direction of the currents flowing through the first conductor portions 25 and 28 are set so as to be the reverse of that of the current flowing through the conductive plate portion 3*a* of the movable contact 3, as shown in FIG. 4(*a*).

Because of this, the magnetic fields generated in the first conductor portions 25 and 28 of the external connection conductors 20 and 21 are superimposed on the magnetic field generated in the conductive plate portion 3*a* of the movable contact 3, and it is thus possible to increase the magnetic flux density around the conductive plate portion 3*a* of the movable contact 3. Consequently, it is possible to generate greater Lorentz forces opposing the magnetic forces generated in the opening direction in the movable contact 3 when current is conducted. As a result of this, it is possible to reliably prevent the movable contact 3 from opening when current is conducted. Because of this, it is possible to further reduce the pressing force of the contact spring 12 supporting the movable contact 3, as a result of which it is also possible to further reduce the thrust generated by the operating electromagnet 4, and it is thus possible to further reduce the size of the overall configuration.

In the second embodiment, a description has been given of a case in which the external connection conductors 20 and 21 are formed in a U-shape, but the invention not being limited to this, it is possible to obtain working effects the same as heretofore described even when an L-shape is configured by the fixed portions 22 and 23 and the first conductor portions 25 and 28 acting concurrently as the external connection conductor portions, as shown in FIG. 4(*b*). Furthermore, an arrangement may be such that the length of the first conductor portions 25 and 28 is halved, and external connection conductor portions 31 and 32 extending from the free ends of the first conductor portions 25 and 28 in a direction opposite to that of the fixed portions 22 and 23, as shown in FIG. 4(*c*).

Figure 5:
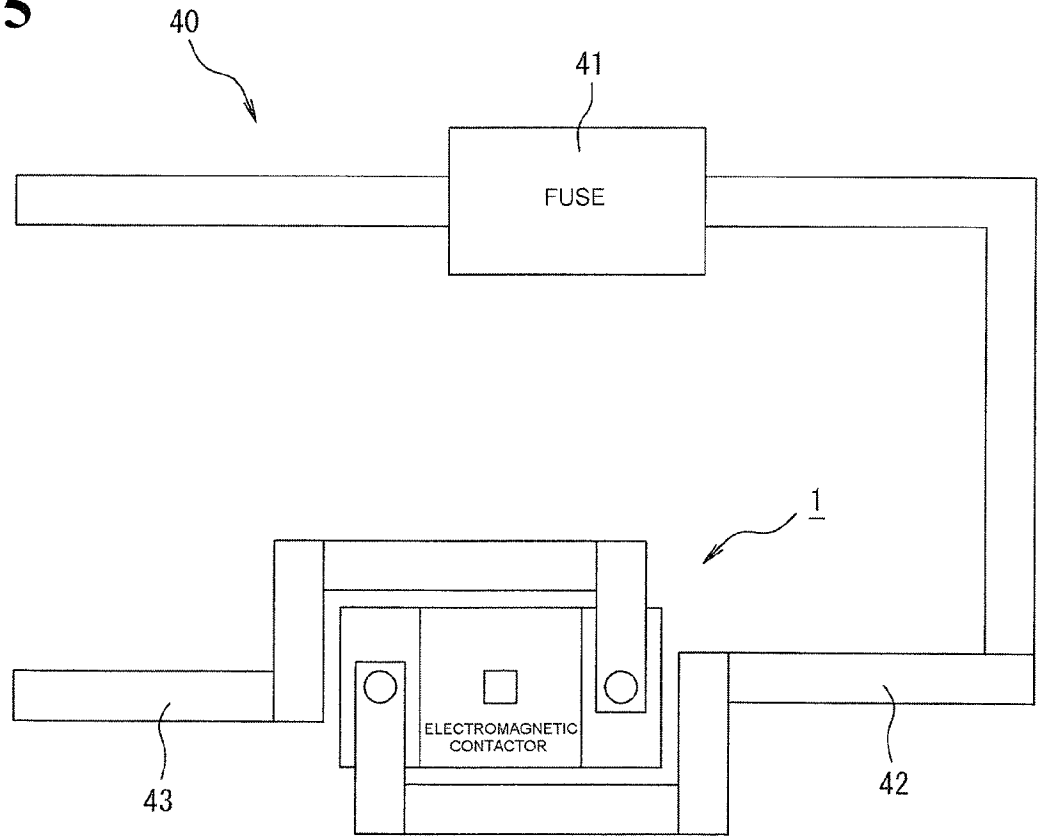
FIG. 5 is a configuration diagram showing a protection unit.

Also, a protection unit 40 of the electromagnetic contactor 1 is configured of a busbar 42 having a fuse 41 interposed between a direct current power source and the external connection terminal 2*i* of the fixed contact 2 of the electromagnetic contactor 1 and a busbar 43 connecting the external connection terminal 2*j* of the fixed contact 2 of the electromagnetic contactor 1 and a load, as shown in FIG. 5. Further, it is possible to obtain working effects the same as in the second embodiment even when a portion of the busbar 42 connected to the external connection terminal 2*j* of the fixed contact 2 is formed in the same shape as the external connection conductor 20 shown in FIG. 4(*a*), and the busbar 43 is formed in the same shape as the external connection conductor 21.

Furthermore, a description will be given, referring to FIG. 6, of a third embodiment of the invention.

In the third embodiment, an arrangement is such that the contact mechanism CM is not affected by the magnetic fields of the external connection conductors 20 and 21.

Figure 6:
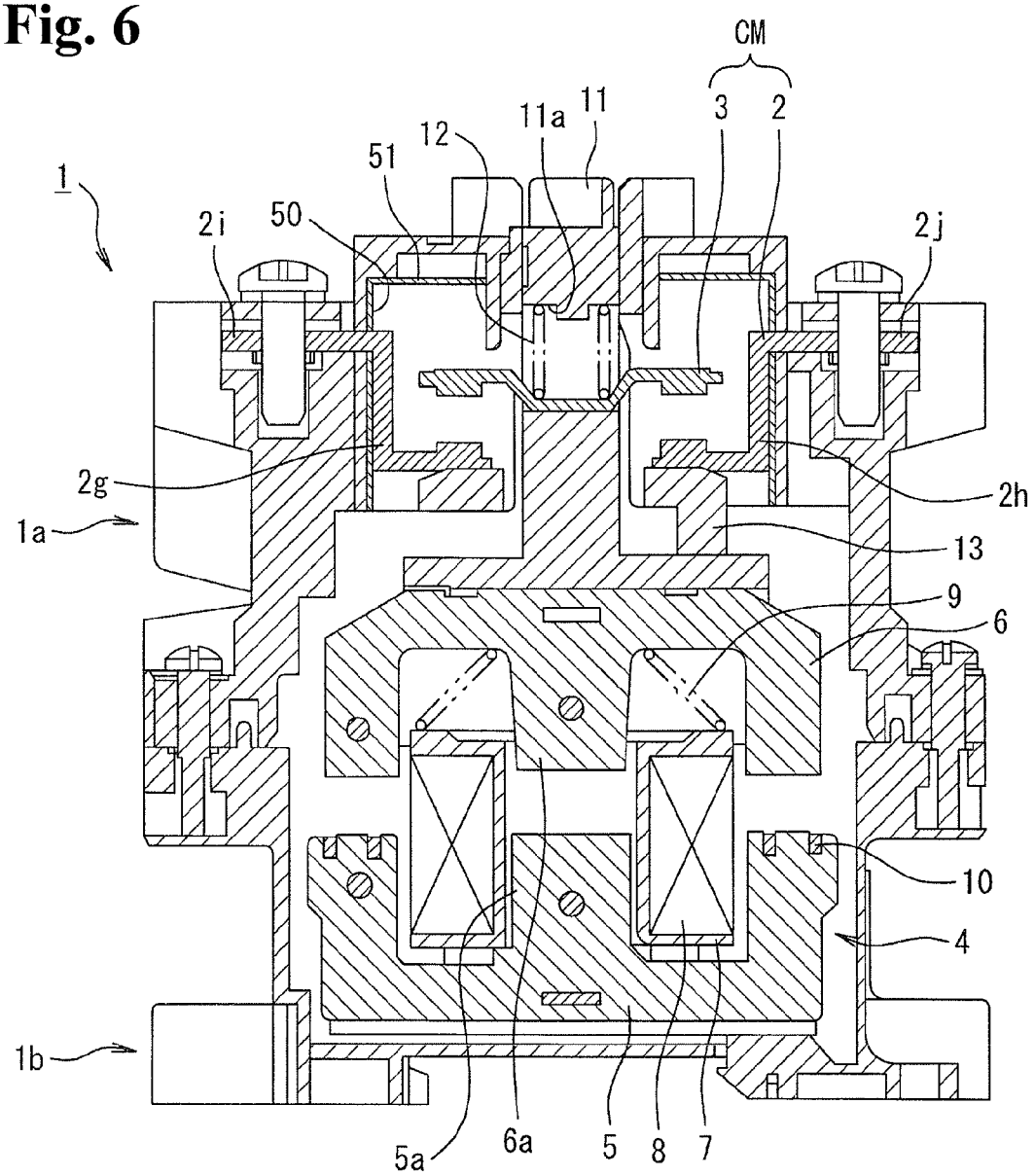
FIG. 6 is a sectional view showing a third embodiment of the electromagnetic contactor of the invention.

That is, in the third embodiment, a configuration is adopted wherein a magnetic shielding body 51 is disposed on the inner wall of a contact housing space 50 of the upper case 1*a* housing the L-shaped conductive plate portions 2*g* and 2*h* of the fixed contacts 2, so as to enclose the L-shaped conductive plate portions 2*g* and 2*h*, as shown in FIG. 6.

Herein, the magnetic shielding body 51 is formed into a tub-shaped magnetic body whose lower end is opened, and an insulating film or insulating layer is formed on at least an inner peripheral surface of the magnetic shielding body 51 contacting the second conductive plate portions 2*e* and 2*f* of the L-shaped conductive plate portions 2*g* and 2*h*.

According to the third embodiment, as the whole of the contact mechanism CM is covered with the magnetic shielding body 51, it is possible to magnetically shield the magnetic fields generated by the currents flowing through the external connection conductors 20 and 21 connected to the external connection terminals 2*i* and 2*j* disposed outside the upper case 1*a*. Because of this, it is possible to reliably prevent an external magnetic field from affecting the magnetic fields generated by the currents flowing through the L-shaped conductive plate portions 2*g* and 2*h* of the fixed contacts 2 and the conductive plate portion 3*a* of the movable contact 3. Consequently, it is possible to reliably prevent the movable contact 3 from opening when current is conducted without weakening the Lorentz forces opposing the electromagnetic forces causing the movable contact to open when current is conducted.

In this case, as the magnetic fields generated in the external connection conductors 20 and 21 are magnetically shielded by the magnetic shielding body 51, it is possible to optionally set the connection direction of the external connection conductors 20 and 21.

In the third embodiment, a description has been given of a case in which the magnetic shielding body 51 is disposed so as to cover the whole of the contact mechanism CM configured of the L-shaped conductive plate portions 2*g* and 2*h* of the fixed contacts and the conductive plate portion 3*a* of the movable contact 3. However, the invention is not limited to the heretofore described configuration, and it is only necessary for the magnetic shielding body 51 to prevent the magnetic fields generated by the currents flowing through the external connection conductors 20 and 21 from affecting regions in which Lorentz forces are generated. Because of this, it is possible to form the magnetic shielding body 51 in only the opposing side surface portions opposite to the external connection terminals 2*i* and 2*j*, or adopt a configuration wherein the front and rear side surfaces are removed from the configuration of FIG. 6.

In the first to third embodiments, a description has been given of a case in which the L-shaped conductive plate portions 2*g* and 2*h* are formed in the fixed contacts 2 into a shape such as to generate Lorentz forces. However, the invention, not being limited to the heretofore described configurations, has a configuration same as those of the first to third embodiments except that, in the heretofore described configuration of FIG. 3 in the first embodiment, the second conductive plate portions 2*e* and 2*f* of the L-shaped conductive plate portions 2*g* and 2*h* of the fixed contacts 2 are bent so as to cover the upper end sides of the end portions of the conductive plate portion 3*a* of the movable contact 3, thus forming third conductive plate portions 2*m* and 2*n* parallel to the conductive plate portion 3*a*, and thereby forming C-shaped conductive plate portions 2*o* and 2*p*, as shown in FIGS. 7(*a*)-7(*c*).

Figure 7A:
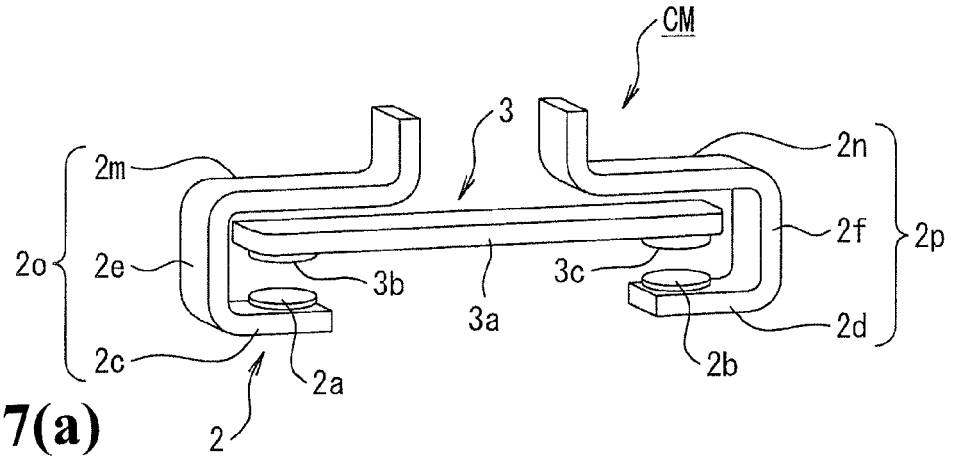
FIG. 7(*a*)-7(*c*) are diagrams showing another example of the contact mechanism which can be applied to the invention, wherein FIG. 7(*a*) is a perspective view, FIG. 7(*b*) is a sectional view showing an open state, and FIG. 7(*c*) is a sectional view showing a closed state.
Figure 7B:
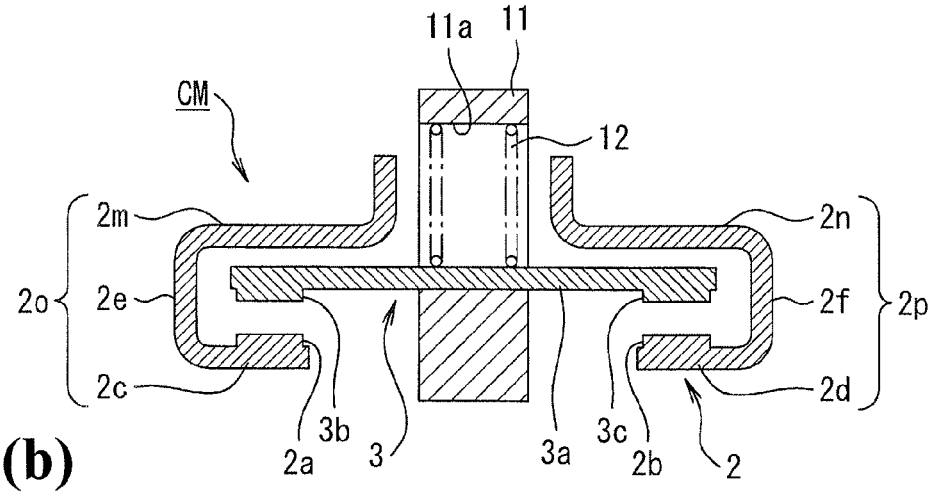
Figure 7C:
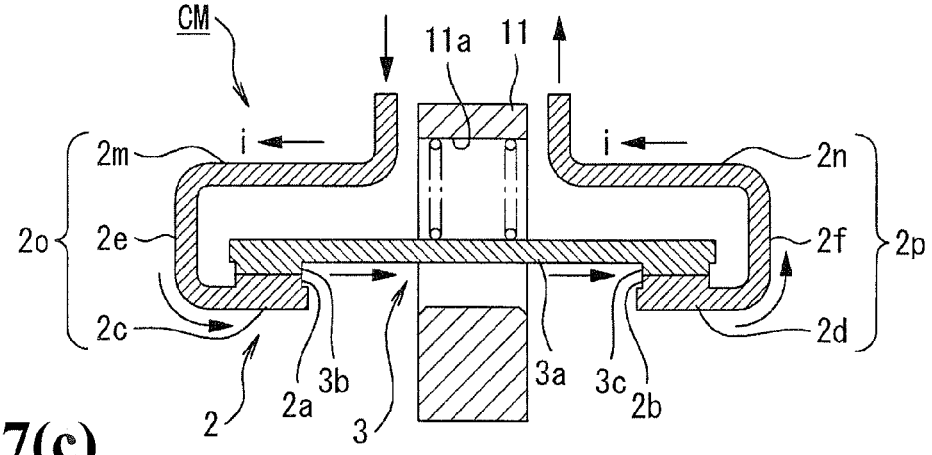

According to this configuration, when the contact mechanism CM attains the closed condition, as shown in FIG. 7(*c*), a large current in the order of, for example, several ten kiloamperes input from, for example, the external connection terminal 2*i* of the fixed contact 2 connected to a direct current power supply (not shown) is supplied to the movable contact portion 3*b* of the movable contact 3 through the third conductive plate portion 2*m*, second conductive plate portion 2*e*, first conductive plate portion 2*c*, and fixed contact portion 2*a*. The large current supplied to the movable contact portion 3*b* is supplied to the fixed contact portion 2*b* through the conductive plate portion 3*a* and movable contact portion 3*c*. The large current supplied to the fixed contact portion 2*b* is supplied to the first conductive plate portion 2*d*, second conductive plate portion 2*f*, third conductive plate portion 2*n*, and external connection terminal 2*j*, and a current conduction path through which the current is supplied to an external load is formed.

At this time, electromagnetic repulsion forces are generated in a direction such as to cause the movable contact portions 3*b* and 3*c* to open between the fixed contact portions 2*a* and 2*b* of the fixed contacts 2 and the movable contact portions 3*b* and 3*c* of the movable contact 3.

However, as the fixed contacts 2 are such that the C-shaped conductive plate portions 2*o* and 2*p* are formed by the first conductive plate portions 2*c* and 2*d*, second conductive plate portions 2*e* and 2*f*, and third conductive plate portions 2*m* and 2*n* respectively, as shown in FIG. 3, the currents in the third conductive plate portions 2*m* and 2*n* of the fixed contacts 2 and the current in the conductive plate portion 3*a* of the movable contact 3 opposite thereto flow in opposite directions. Because of this, from the relationship between magnetic fields formed by the third conductive plate portions 2*m* and 2*n* of the fixed contacts 2 and the current flowing through the conductive plate portion 3*a* of the movable contact 3, it is possible, in accordance with Fleming's left-hand rule, to generate Lorentz forces which press the conductive plate portion 3*a* of the movable contact 3 against the fixed contact portions 2*a* and 2*b* of the fixed contacts 2. Due to the Lorentz forces, it is possible to oppose the electromagnetic repulsion forces generated in the opening direction between the fixed contact portions 2*a* and 2*b* of the fixed contacts 2 and the movable contact portions 3*b* and 3*c* of the movable contact 3, and thus possible to prevent the movable contact portions 3*b* and 3*c* of the movable contact 3 from opening.

Figure 8A:
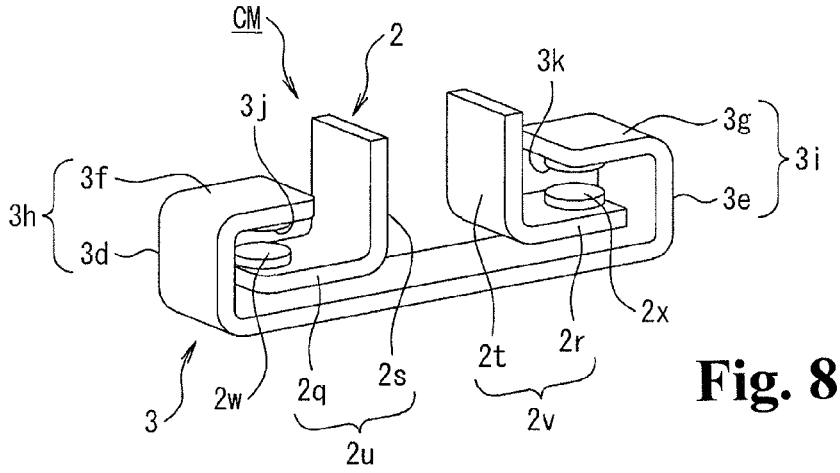
FIGS. 8(*a*)-8(*c*) are diagrams showing still another example of the contact mechanism which can be applied to the invention, wherein FIG. 8(*a*) is a perspective view, FIG. 8(*b*) is a sectional view showing an open state, and FIG. 8(*c*) is a sectional view showing a closed state.
Figure 8B:
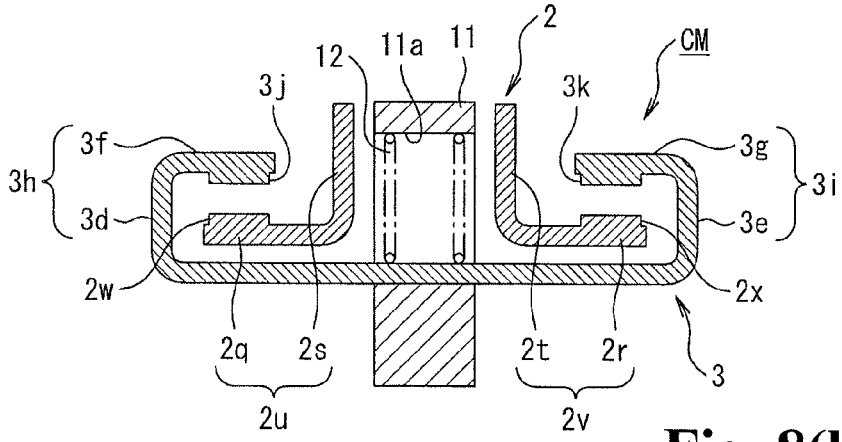
Figure 8C:
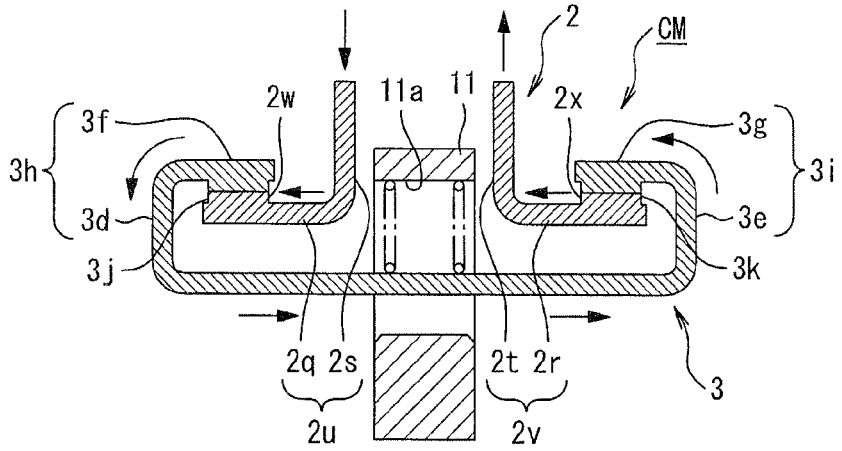

Furthermore, an arrangement may be such that the shape of the movable contact 3 is changed, as shown in FIGS. 8(*a*)-8(*c*), to generate Lorentz forces opposing the electromagnetic forces in the opening direction when current is conducted.

That is, a C-shaped bent portion 3*h*, 3*i* bent toward the upper side of the conductive plate portion 3*a* is formed by a first conductive plate portion 3*d*, 3*e* extending upward from each respective end side of the conductive plate portion 3*a* of the movable contact 3 and a second conductive plate portion 3*f*, 3*g* extending inward from the upper end of the first conductive plate portion 3*d*, 3*e*, as shown in FIGS. 8(*a*)-8(*c*). Movable contact portions 3*j* and 3*k* are formed on the leading end side lower surfaces of the second conductive plate portions 3*f* and 3*g* of the C-shaped bent portions 3*h* and 3*i* respectively.

Also, each of the fixed contacts 2 is such that an L-shaped conductive plate portion 2*u*, 2*v* is formed by a fourth conductive plate portion 2*q*, 2*r*, extending inward, which is opposite between the conductive plate portion 3*a* and second conductive plate portion 3*f*, 3*g* which form the C shaped bent portion 3*h*, 3*i* of the movable contact 3, in the open state of the contact mechanism CM, and a fifth conductive plate portion 2*s*, 2*t* extending upward from the inward end of the fourth conductive plate portion 2*q*, 2*r* through the inner side of the inner side end portion of the C-shaped bent portion 3*h*, 3*i* of the movable contact 3. Further, fixed contact portions 2*w* and 2*x* are formed in positions on the fourth conductive plate portions 2*q* and 2*r* opposite to the movable contact portions 3*j* and 3*k* of the movable contact 3.

According to the configuration of FIGS. 8(*a*)-8(*c*), when the contact mechanism CM attains the closed condition, as shown in FIG. 8(*c*), a large current in the order of, for example, several ten kiloamperes input from, for example, the external connection terminal 2*i* of the fixed contact 2 connected to a direct current power supply (not shown) is supplied to the movable contact portion 3*j* of the movable contact 3 through the fifth conductive plate portion 2*s*, fourth conductive plate portion 2*q*, and fixed contact portion 2*w*. The large current supplied to the movable contact portion 3*j* is supplied to the fixed contact portion 2*x* through the second conductive plate portion 3*f*, first conductive plate portion 3*d*, conductive plate portion 3*a*, first conductive plate portion 3*e*, second conductive plate portion 3*g*, and movable contact portion 3*k*. The large current supplied to the fixed contact portion 2*x* is supplied to the fourth conductive plate portion 2*r*, fifth conductive plate portion 2*t*, and external connection terminal 2*j*, and a current conduction path, a current conduction path supplied to an external load.

At this time, electromagnetic repulsion forces are generated in a direction such as to cause the movable contact portions 3*j* and 3*k* to open between the fixed contact portions 2*w* and 2*x* of the fixed contacts 2 and the movable contact portions 3*j* and 3*k* of the movable contact 3.

However, as the movable contact 3 is such that the C shaped bent portion 3*h*, 3*i* is formed by the conductive plate portion 3*a*, first conductive plate portion 3*d*, 3*e*, and second conductive plate portion 3*f*, 3*g*, the current in the conductive plate portion 3*a* of the movable contact 3 and the currents in the fourth conductive plate portions 2*q* and 2*r* of the fixed contacts 2 flow in opposite directions. Because of this, Lorentz forces which press the movable contact portions 3*j* and 3*k* of the movable contact 3 against the fixed contact portions 2*w* and 2*x* of the fixed contacts 2 can be generated in the conductive plate portion 3*a* by the magnetic field formed by the current flowing through the conductive plate portion 3*a* of the movable contact 3 and the current flowing through the fourth conductive plate portions 2*q* and 2*r* of the fixed contacts 2, as shown in FIG. 8(*c*). Due to the Lorentz forces, it is possible to oppose the electromagnetic repulsion forces generated in the opening direction between the fixed contact portions 2*w* and 2*x* of the fixed contacts 2 and the movable contact portions 3*j* and 3*k* of the movable contact 3, and thus possible to prevent the movable contact portions 3*j* and 3*k* of the movable contact 3 from opening when a large current is conducted.

Furthermore, with the configuration of FIGS. 8(*a*)-8(*c*), as the L-shaped conductive plate portions 2*u* and 2*v* are formed in their respective fixed contacts 2, magnetic flux strengthening portions are formed on the upper sides of the second conductive plate portions 3*f* and 3*g* of the movable contact 3 by the fifth conductive plate portions 2*s* and 2*t* of the L-shaped conductive plate portions 2*u* and 2*v*, meaning that it is also possible to generate Lorentz forces the same as those in the first embodiment, and thus possible to more potently prevent the movable contact 3 from opening.

In the first to third embodiments, a description has been given of a case in which the fixed portions 22 and 23 of the external connection conductors 20 and 21 are disposed in a direction perpendicular to the current direction of the movable contact 3, but the invention not being limited to this, the fixed portions 22 and 23 may be crossed at an angle such that the magnetic fields generated by the currents flowing through the fixed portions 22 and 23 do not cause the Lorentz forces to decrease.

INDUSTRIAL APPLICABILITY

According to the invention, it is possible to provide an electromagnetic contactor with which it is possible to suppress electromagnetic repulsion forces which cause a movable contact to open when current is conducted, without any effect of the magnetic fields of external connection conductors.

What is claimed is:

1. An electromagnetic contactor comprising:

a contact mechanism including a pair of fixed contacts having fixed contact portions interposed in a current conduction path, and a movable contact having a pair of movable contact portions contacting to and separating from the pair of fixed contact portions, wherein at least one of the pair of fixed contacts or the movable contact is formed in a shape to form magnetic fields generating Lorentz forces opposing electromagnetic repulsion forces generated in an opening direction between the fixed contact portions and the movable contact portions when current is conducted, and external connection conductors, each having a fixed portion connected to external connection terminals of the fixed contacts and extending laterally outwardly from a case, an attachment direction of each of the fixed portions fixed to the external connection terminal of the fixed contacts being set to cross a current flow direction flowing through the movable contact, wherein the attachment direction of one of the fixed portions is opposite to the attachment direction of another of the fixed portions to cross the current flow direction flowing through the movable contact, each of the external connection conductors further includes a first conductor portion connected to an end of the fixed portion at aside opposite to the external connection terminal and extending parallel to the movable contact along a front surface of the case, and each of the external connection conductors further includes a second conductor portion connected to an end of the first conductor portion at a side opposite to the fixed portion and extends to a side opposite to the external connection terminal along the front surface of the case and parallel to the fixed portion, and a third conductor portion connected to the second conductor portion connected to an end of the second conductor portion at a side opposite to the first conductor portion and extends parallel to the movable contact.

* * * * *